US006572487B1

(12) United States Patent
Ruff

(10) Patent No.: US 6,572,487 B1
(45) Date of Patent: Jun. 3, 2003

(54) GOLF CLUB REST

(76) Inventor: Thomas L. Ruff, 8053 Albany Post Rd., Red Hook, NY (US) 12571

( * ) Notice: Subject to any disclaimer, the term of this patent is extended or adjusted under 35 U.S.C. 154(b) by 0 days.

(21) Appl. No.: 09/678,277

(22) Filed: Oct. 3, 2000

(51) Int. Cl.[7] ..... A63B 55/10
(52) U.S. Cl. ..... 473/282; 211/70.2; 248/156
(58) Field of Search ..... D6/552; D21/796; 473/282; 211/70.2, 70.8; 248/530, 520, 155.1, 156; 43/21.2

(56) References Cited

U.S. PATENT DOCUMENTS

| | | | | |
|---|---|---|---|---|
| 2,426,443 A | * | 8/1947 | Fetterman | |
| 4,913,389 A | * | 4/1990 | McCracken | |
| 5,076,581 A | | 12/1991 | Boberg | 273/32 R |
| 5,080,239 A | | 1/1992 | Rowland | 211/70.2 |
| 5,127,530 A | | 7/1992 | Ortuno | 211/70.2 |
| 5,187,891 A | * | 2/1993 | Stanishewski | |
| D335,994 S | * | 6/1993 | Cude | |
| 5,285,990 A | | 2/1994 | Engel | 248/156 |
| D360,248 S | * | 7/1995 | Wright | |
| 5,467,980 A | | 11/1995 | Weisenstein | 273/32 B |
| 5,636,754 A | | 6/1997 | Ennis | 211/70.2 |
| 5,704,847 A | | 1/1998 | Glennon | 473/282 |

* cited by examiner

*Primary Examiner*—Stephen Blau
(74) *Attorney, Agent, or Firm*—Wayne F. Reinke, Esq.; Heslin Rothenberg Farley & Mesiti P.C.

(57) ABSTRACT

A unitary golf club rest includes a golf club support at one end and a turf piercing element at the other end. A foot press is situated between the two ends. The golf club support is roughly V-shaped with a cushioned surface, and also acts as a handle for the golf club rest. The turf piercing element has a blunted tip. The foot press also acts to stabilize the golf club rest when placed in the ground, as well as a stop for the golf club rest.

2 Claims, 2 Drawing Sheets

GOLF CLUB REST

BACKGROUND OF THE INVENTION

1. Technical Field

The present invention generally relates to support apparatus. More particularly, the present invention relates to a golf club rest for temporarily supporting one or more golf clubs.

2. Background Information

In the past, golfers waiting their turn to swing have either left the club they intend to use in their golf bag, laid it on the ground or simply held onto it. In addition, golfers with multiple clubs out of the golf bag at a given time (e.g., driving range, course or park) have had to put unused clubs on the ground while hitting a shot. Finally, golfers fetching a stray ball have also had to put their club on the ground to pursue the ball, for example, into the woods. In any of these situations, to place the club on the ground could result in water, dirt or other debris getting on the club, which could affect a shot made therewith, or may simply be unsightly. In all these scenarios, the golfer has had no clean, convenient place to temporarily rest his or her club.

Prior attempts at addressing this problem have included small disks or cards intended simply to keep the handle of one club off the ground. However, such solutions still require the club to be set essentially horizontally on the ground, which does nothing to prevent soiling of the rest of the club. Moreover, if the grasses where the club is set down is relatively high, the disk or card may not be high enough even to keep the handle clean, dry and visible. Other attempts have focused on stands placed in the ground, which was an improvement. However, these stands were too elaborate (e.g., multi-piece units), which were cumbersome to assemble and suffered from instability, and/or were difficult to get into the ground, especially if a golfer had only a single free hand.

Thus, a need exists for a golf club rest that keeps all but the head off the ground, is unitary in construction, stable, and provides a simple vehicle for entry into the ground.

SUMMARY OF THE INVENTION

Briefly, the present invention satisfies the need for a clean, convenient place to temporarily rest a golf club by providing for vertical resting of one or more golf clubs. A golf club rest with unitary construction eliminates the problems associated with multi-piece units. A foot press to assist with entry of the golf club rest into the ground may also serve as a stop, as well as providing stability.

In accordance with the above, it is an object of the present invention to provide a golf club rest addressing the shortcomings of previous golf club rests.

The present invention provides, in a first aspect, a golf club rest. The golf club rest comprises a golf club support at one end, and a turf piercing element at the other end. The golf club rest further comprises a foot press situated between the ends. The golf club support, turf piercing element, and foot press are coupled so as to be unitary.

The present invention provides, in a second aspect, a golf club rest. The golf club rest comprises a combination handle and golf club support at one end, and a blunted turf piercing element at the other end. Between the ends is a combination foot press and stop. The combination handle and golf club support, blunted turf piercing element and combination foot press and stop are coupled so as to be unitary.

These, and other objects, features and advantages of this invention will become apparent from the following detailed description of the various aspects of the invention taken in conjunction with the accompanying drawings.

BEST MODE FOR CARRYING OUT THE INVENTION

The present invention improves the golfing experience by providing a simple and secure way to temporarily vertically support one or more golf clubs. A unitary design promotes a long life without the concern of disassembly or breakage associated with multi-piece golf club supports. A foot press allows single-handed placement of the golf club rest in the turf. The foot press also acts as a stabilizer and stop for the golf club rest after placement in the ground. Finally, the specially designed rest area with cushioned support prevents scratches on the club and/or handle, while serving as a convenient handle to grip the club rest while carrying and inserting into the turf.

Figure 1:
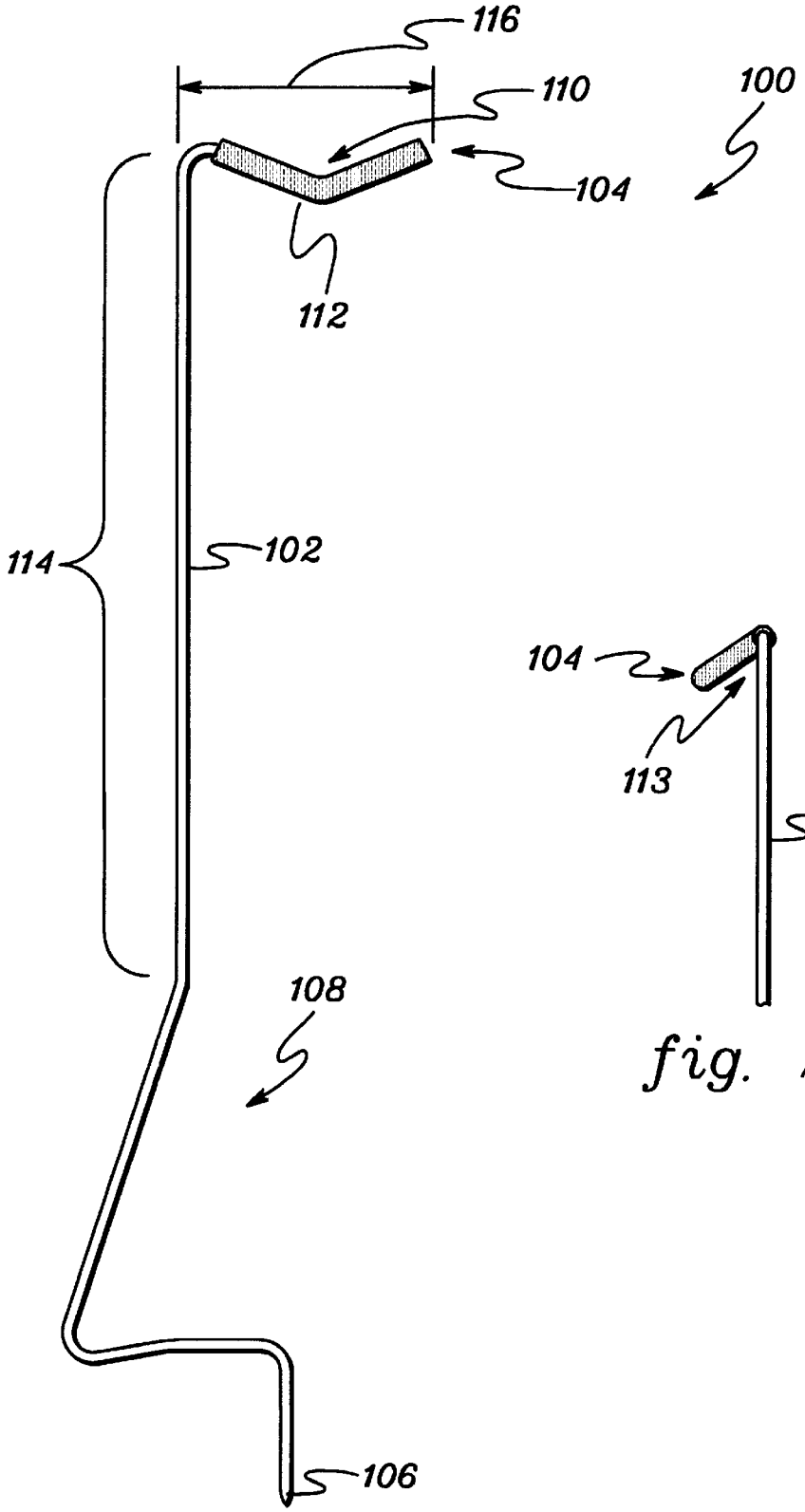
FIG. 1 depicts an example of a golf club rest in accordance with the present invention.

FIG. 1 depicts an example of a golf club rest 100 in accordance with the present invention. The golf club rest comprises a unitary rod 102, including a golf club support 104 at a first end, and a turf piercing element 106 at a second end opposite the first end. The golf club rest also comprises a foot press 108 for assisting with placing the golf club rest in the ground and serves as a stop point. As best shown in FIG. 1, the golf club support and foot press extend outward in opposite directions in order to counterbalance each other.

As shown in FIG. 1, unitary rod 102 comprises a solid circular metal rod of about ¼ inch thickness. Various metals could be used, for example, aluminum or metal alloys. Of course, other sizes, shapes and materials could be used for the unitary rod. As used herein, the term "unitary" refers to a workpiece that is permanently unified other than by fastening. For example, the various sections of the golf club support described herein could be welded together and still be considered unitary, but could not be connected with screws or other fasteners. The use of fasteners would result in a multi-piece unit. As another example of "unitary," the various sections of the golf club support of the invention could be created by bending a single rod, as in the embodiment of FIG. 1.

Figure 2:
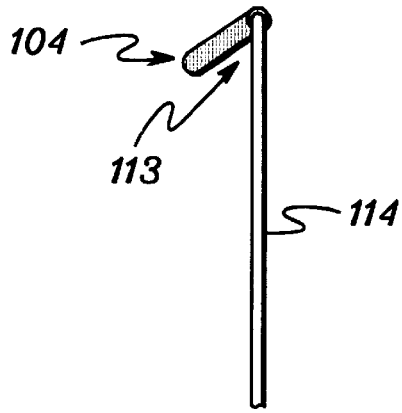
FIG. 2 is a side view of the golf club support/handle section of the golf club rest of FIG. 1.

As best shown in FIG. 1, golf club support 104 comprises a roughly V-shape, with the angle 110 being about 100 degrees. It is within the angled area that one or more clubs would rest (see FIG. 5). Preferably, a cushioned surface 112 is provided to reduce the risk of scratches or other damage to a golf club when rested. For example, various types of foam could be used. More detail regarding the golf club support 104 is shown in FIG. 2. In particular, FIG. 2 shows the golf club support pointing (via the "point" of the roughly V-shaped section) at an angle 113 of less than about 90 degrees (as shown in FIG. 2, angle 113 is about 68 degrees) with respect to straight section 114 coupled to the golf club support. This angle enhances the stability of a golf club when resting thereon as compared to a zero angle. Angle 113 also serves as a means to secure the club rest on the side of a golf bag, like a hook, allowing gravity to hold the club rest in place. Golf club support 104 also serves as a handle for the golf club rest, and, therefore, preferably includes cushioning around the entire golf club support, rather than just where a golf club would rest. Returning now to FIG. 1, typical dimensions for golf club support 104 include a width 116 of about 4½ inches, and about 16 inches for a length of straight section 114, while foot press 108 is about 5 inches and a total height of the golf club rest is about 2 feet.

Figure 3:
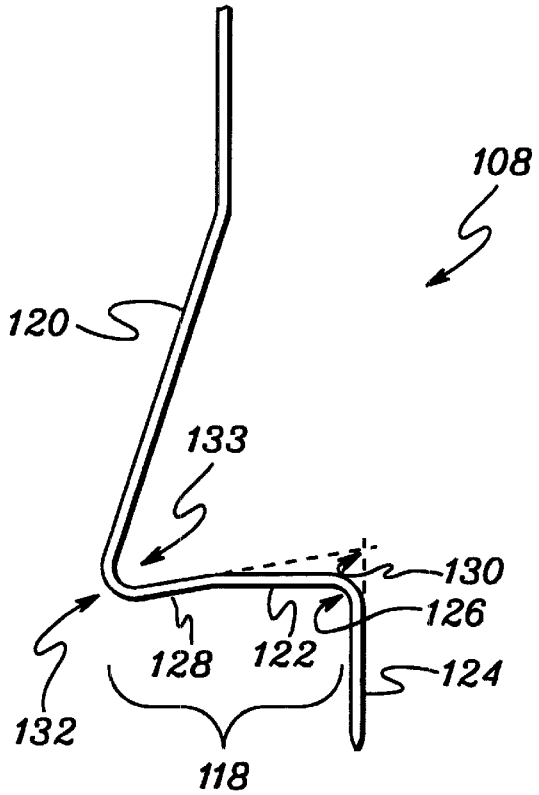
FIG. 3 is a more detailed view of the foot press/stop section of the golf club rest of FIG. 1.

FIG. 3 is a more detailed view of foot press 108 of FIG. 1. As shown in FIG. 3, the foot press comprises a first segment 118 of the unitary rod coupled to a second segment 120. Segment 118 preferably comprises a first portion and a second portion. First portion 122 is coupled to a straight section 124 of the unitary rod at an angle 126 of about 90 degrees (as shown in FIG. 3, about 85 degrees). First portion 122 provides an area where a golfer can place his or her foot in order to press down to assist with entry of turf piercing element 106 into the ground. Segment 118 also comprises a second portion 128 coupled to the first portion at an angle 130 with respect to straight section 124 of less than angle 126 (i.e., less than about 90 degrees). In this way, the second portion preferably bends downward slightly, such that when the golf club rest has been placed in the turf, end 132 of segment 118 provides added stability (see FIG. 5) by acting as an anchor or a second point of contact, thereby better stabilizing the club rest. Segment 120 is coupled to first segment 118 at an angle 133 of less than 90 degrees (in FIG. 3, an angle of about 74 degrees).

Of course, other embodiments for the foot press are possible. For example, where two or more separate metal pieces are welded together to form a unitary golf club rest, the foot press need not include segment 120 in FIG. 3. Segment 118 could, for example, simply be welded onto a straight metal rod. However, segment 120 allows for easy placement and retrieval from the golf bag, by decreasing the possibility of catching on other items. As another example, segment 118 could, instead of comprising two portions, comprise a single straight section bent such that angle 126 is less than 90 degrees. This would serve a similar purpose to the embodiment of FIG. 3.

Figure 4:
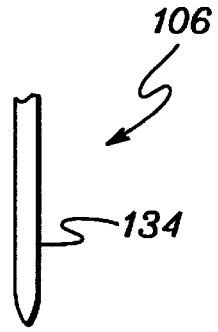
FIG. 4 is an exploded view of the turf piercing element of the golf club rest of FIG. 1.

FIG. 4 is an exploded view of the turf piercing element 106 of FIG. 1. As shown in FIG. 4, turf piercing element 106 preferably comprises a blunted tip 134 to help minimize possible injury to the golfer, while still providing the function of turf piercing.

Figure 5:
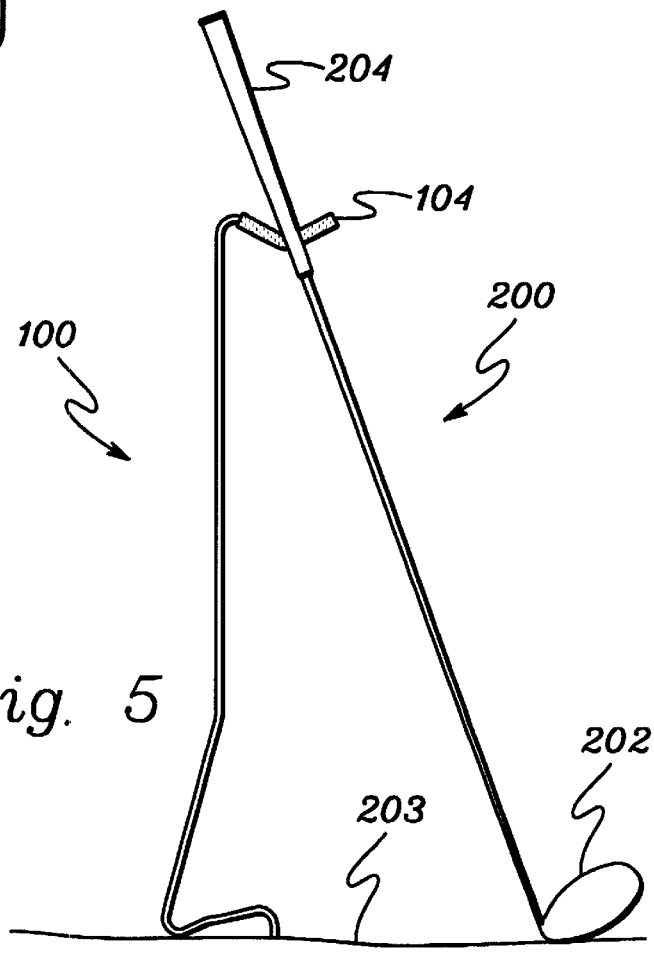
FIG. 5 depicts the golf club rest of FIG. 1 in use.

FIG. 5 depicts golf club rest 100 of FIG. 1 in use. As shown in FIG. 5, a golf club 200 rests against golf club rest 100, with the head 202 resting on ground 203 and the handle 204 securely resting against cushioned surface 112 of golf club support 104.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

What is claimed is:

1. A golf club rest, comprising:

a golf club support at a first end of the golf club rest;

a turf piercing element at a second end of the golf club rest opposite the first end;

a foot press situated between the first end and the second end of the golf club rest;

wherein the golf club support, turf piercing element and foot press are coupled so as to be unitary;

a straight section between the turf piercing element and the foot press; and wherein the foot press comprises:

a first segment coupled to the straight section at a first angle of about 90 degrees with respect to the straight section;

a second segment coupled to the first segment at a second angle of less than 90 degrees with respect to the first segment;

wherein the first segment comprises a first portion coupled to the straight section and a second portion coupled to the second segment; and wherein the second portion is at a third angle with respect to the straight section of less than 90 degrees.

2. A golf club rest, comprising:

a combination handle and golf club support at a first end of the golf club rest;

a blunted turf piercing element at a second end of the golf club rest opposite the first end;

a combination foot press and stop between the first end and the second end of the golf club rest;

wherein the combination handle and golf club support, blunted turf piercing element and combination foot press and stop are coupled so as to be unitary;

a straight section between the blunted turf piercing element and the combination foot press and stop; and wherein the combination foot press and stop comprises:

a first segment coupled to the straight section at a first angle of about 90 degrees with respect to the straight section;

a second segment coupled to the first segment at an angle of less than 90 degrees with respect to the first segment;

wherein the first segment comprises a first portion coupled to the straight section and a second portion coupled to the second segment; and wherein the second portion is at a third angle with respect to the straight section of less than 90 degrees.

* * * * *